US006109179A

United States Patent [19]

Childress

[11] Patent Number: 6,109,179

[45] Date of Patent: Aug. 29, 2000

[54] COMPOSITE PRINTING BAND AND METHOD OF MAKING SAME

[75] Inventor: John L. Childress, Huber Heights, Ohio

[73] Assignee: Monarch Marking Systems, Inc., Dayton, Ohio

[21] Appl. No.: 09/324,928

[22] Filed: Jun. 3, 1999

[51] Int. Cl.[7] ..... B41N 6/00; B41J 1/20

[52] U.S. Cl. ..... 101/401.1; 101/111; 264/132

[58] Field of Search ..... 101/401.1, 404, 101/406, 111; 264/132; 400/146

[56] References Cited

U.S. PATENT DOCUMENTS

| | | | |
|---|---|---|---|
| 685,473 | 10/1901 | Hill . | |
| 798,460 | 8/1905 | Scotford . | |
| 2,950,048 | 8/1960 | Luhn . | |
| 3,418,929 | 12/1968 | Nelson . | |
| 3,968,745 | 7/1976 | Hamisch, Jr. . | |
| 3,977,321 | 8/1976 | Pabodie . | |
| 4,119,030 | 10/1978 | Funahashi | 101/111 |
| 4,263,242 | 4/1981 | Jenkins . | |
| 4,387,644 | 6/1983 | Jenkins | 101/111 |
| 4,392,424 | 7/1983 | Schrotz et al. . | |
| 4,843,960 | 7/1989 | Ernst et al. | 101/111 |
| 5,983,789 | 11/1999 | Fogle | 101/111 |

*Primary Examiner*—Eugene Eickholt
*Attorney, Agent, or Firm*—Joseph J. Grass

[57] ABSTRACT

There is disclosed an endless flexible printing band and method of making such printing bands. A wide endless band having columns and rows of raised printing characters is molded onto a sheet having columns and rows of visually readable characters corresponding to the printing characters. Following molding, the wide band is slit into a plurality of printing bands.

10 Claims, 2 Drawing Sheets

COMPOSITE PRINTING BAND AND METHOD OF MAKING SAME

CROSS-REFERENCE TO RELATED APPLICATION

Reference is hereby made to co-owned, U.S. patent application Ser. No. 09/238,986 now U.S. Pat. No. 5,983,789 filed Jan. 28, 1999.

BACKGROUND OF THE INVENTION

1. Field of the Invention

This invention relates to the art of printing bands and to method of making printing bands.

2. Brief Description of the Prior Art

The following prior art U.S. Pat. Nos. are made of record: 685,473; 798,460; 2,950,048; 3,418,929; 3,968,745; 3,977,321; 4,263,242; and 4,392,424.

Some prior art printing bands have a column of raised outwardly projecting printing characters and a column of raised outwardly projecting visually readable characters. Because the column of printing characters occupies almost one half of the band length, the printing characters are considered to comprise the printing-half of the band, and likewise because the column of visually readable character occupies almost one-half of the band length, the visually readable characters are considered to comprise the read-half of the band. In that both the printing characters and the visually readable characters are raised, both the part of the mold which forms the printing-half and the part of the mold that forms the read-half are made from engraved dies. In that both the printing characters and the read characters are raised, the print cavity portions for forming the printing characters and the read cavity portions for forming the read characters are provided by recesses in the dies. The manufacture of dies with small print cavity portions is difficult, and the manufacture of dies with even smaller print cavity portions is even more difficult because the engraving tool is required to engrave contours inside a cavity. It sometimes happens that a small air bubble will prevent the moldable elastomeric material from filling the cavity portions. This is due to the fact that the ends of individual print cavity portions and read cavity portions are not vented. This bubble can cause a void in a printing character or in a visually readable character. A void in a printing character can cause that printing character to print poorly, and a void in a visually readable character can cause the visually readable character to be more difficult to read. It sometimes happens that part of a printing character or part of a visually readable character becomes stuck in a respective printing cavity portion or in a visually readable cavity portion. Consequently, when the band is removed from the mold, part of the printing character and/or part of the visually readable character is torn off and remains in the mold. This degrades the quality of the band and means that the band has to be scrapped. Also, when elastomeric material is struck in a cavity portion, unless removed, that material can form a void in subsequent printing bands that are molded.

The elastomeric material from which the bands are molded is typically black or dark in color. It is very difficult to read the visually readable characters unless there is some contrasting color. A technique for rendering raised visually readable characters more readily readable is found in co-owned U.S. Pat. No. 4,263,242. Another is found in co-owned pending U.S. patent application Ser. No. 09/238,986 filed Jan. 28, 1999. Yet another known technique is to simply coat the tops of the visually readable characters with a coating of a color-contrasting material. Such further processing of the printing band adds cost to the manufacturing process. A flaw in any added step in the process may result in a scrap printing band, thereby raising the cost of useable printing bands.

SUMMARY OF THE INVENTION

This invention relates to an improved, low cost, readily manufacturable printing band.

It is a feature of the invention to provide an improved composite printing band having a printing portion and a reading portion wherein the reading portion is provided by a strip of visually readable characters adhered to the printing band.

It is another feature of the invention to provide an improved printing band made from a wide endless composite sleeve or band, wherein there is a wide molded endless flexible band composed of an appropriate elastomer and having columns and rows of outwardly facing raised printing characters, and a sheet having columns and rows of outwardly facing, printed, visually readable characters adhered to and preferably molded to the wide endless band, and wherein the visually readable characters correspond to and are registered with like printing characters. Following molding, the wide band is slit into a plurality of printing bands. It is preferred that the wide composite band is made by molding elastomeric material directly onto the printed sheet of visually readable characters. In this way the process is readily repeatable and is thus suitable for large volume commercial production.

DETAILED DESCRIPTION OF THE PREFERRED EMBODIMENTS

Figure 1:
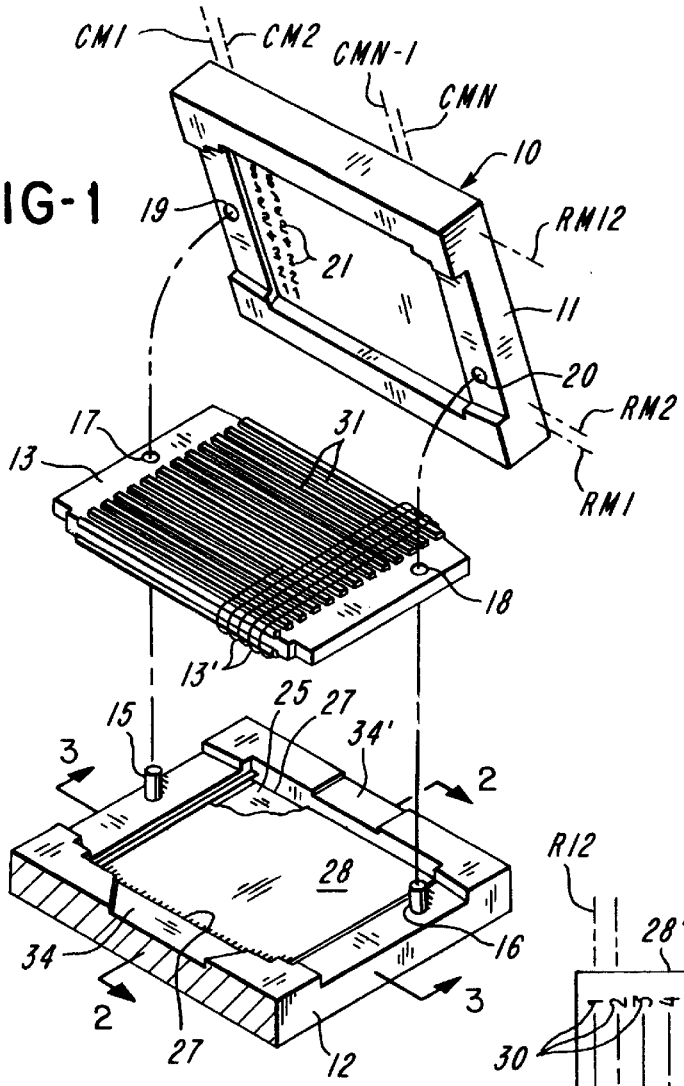
FIG. 1 is a partially rotated perspective view of a mold with upper and lower mold parts and an intervening mold blade showing a printed sheet facedown in the lower mold part and showing threads or cords wrapped about the mold blade.

With reference to FIG. 1, there is shown a mold generally indicated at 10 having an upper mold part 11, a lower mold part 12 and a generally rectangular mandrel or mold blade 13. The mold parts 11 and 12 and the mold blade 13 are accurately located relative to each other by locating pins 15 and 16 which pass through respective locating holes 17 and 18 in the mold blade 13 and are received in respective locating holes 19 and 20 in the upper mold part 11.

Figure 5:
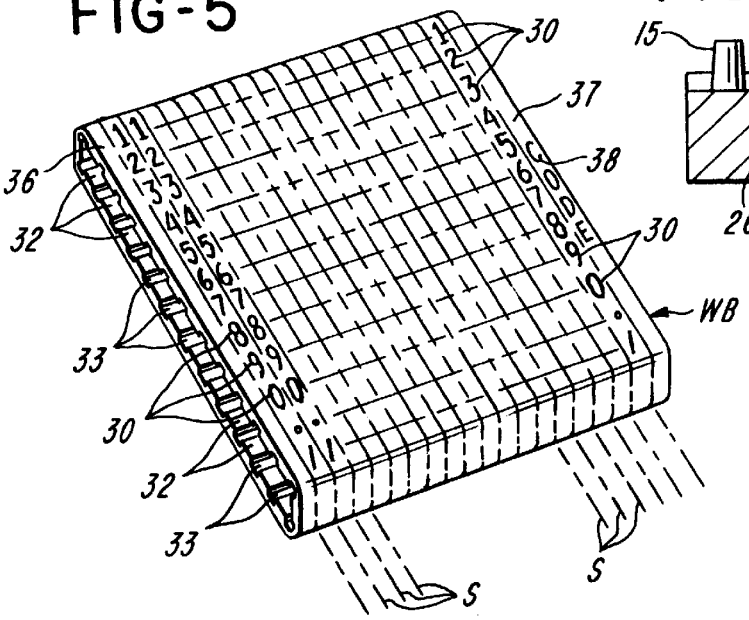
FIG. 5 is a perspective view of a wide endless band or sleeve which results from molding using the mold shown in FIGS. 1, 2 and 3.
Figure 6:
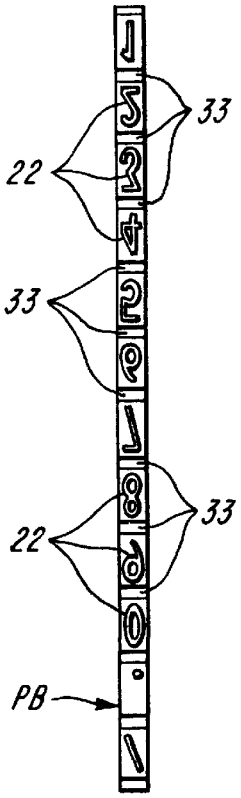
FIG. 6 is a view showing the printing characters on one side of a printing band which has been slit from the wide endless band shown in FIG. 5.

The inner side of the upper mold part 11 has columns and rows of cavity portions 21 for forming raised printing characters 22 (FIGS. 5 and 6). The printing characters 22 are formed on underlying integrally molded pads or blocks 23.

Figure 4:
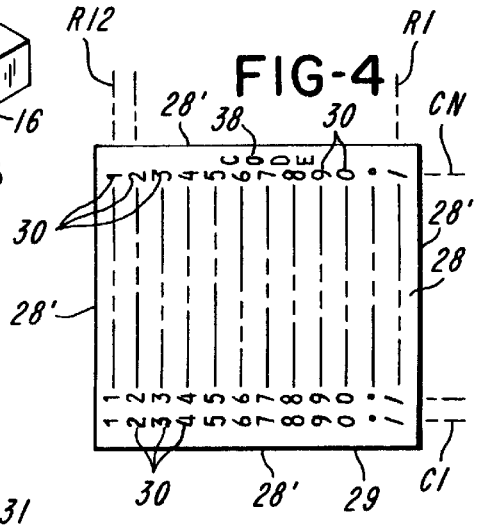
FIG. 4 is a bottom plan view of the printed sheet shown in FIGS. 1, 2 and 3.
Figure 2:
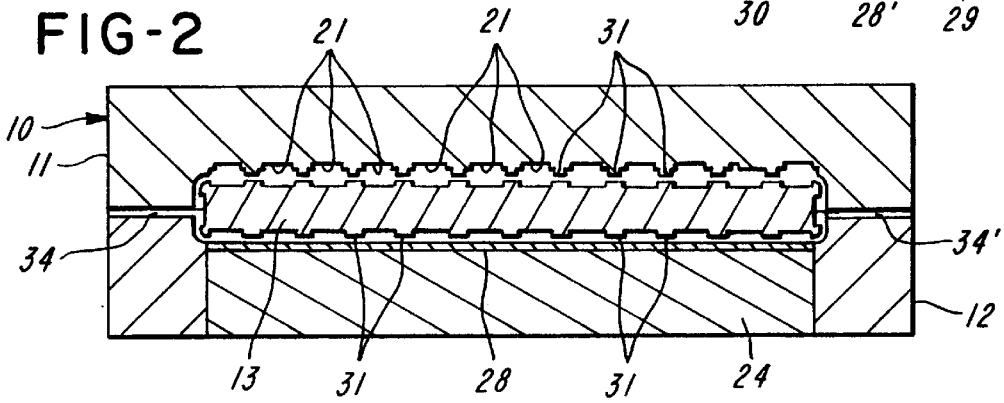
FIG. 2 is a sectional view of the assembled mold before injection of moldable material taken along line 2—2 of FIG. 1 showing the printed sheet, but omitting the threads for the sake of clarity.
Figure 3:
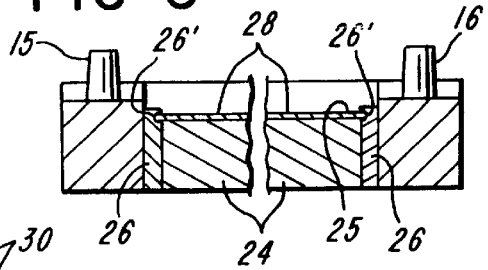
FIG. 3 is a fragmentary sectional view of the lower mold part taken generally along line 3—3 of FIG. 1.
Figure 7:
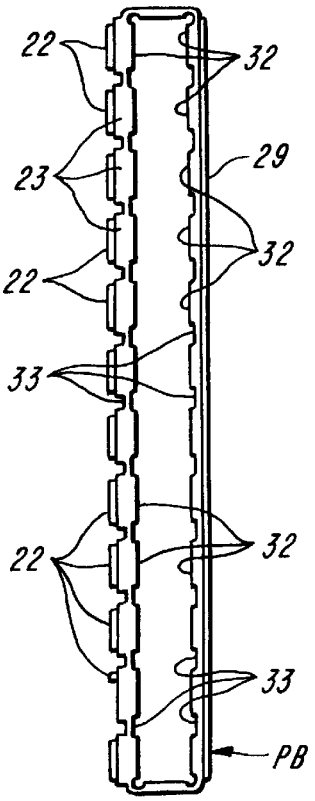
FIG. 7 is an end view of the printing band shown in FIG. 6.
Figure 8:
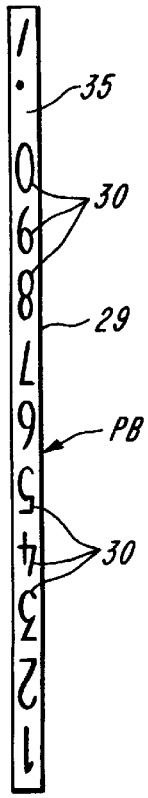
FIG. 8 is a view showing the visually readable characters on the other side of the printing band.

The lower mold part 12 anchors the locating pins 15 and 16 as shown in FIGS. 1, 2 and 3. A floor 24 has a flat, smooth, rectangular surface 25. A pair of opposed locators 26 have opposed channels 26'. The channels 26' are holders which hold and locate two opposite ends of the printed sheet 28 in a position flat against the surface 25 both before and during molding. This prevents moldable material from flowing between the sheet 28 and the surface 25. The lower mold part 12 also has opposed parallel walls or locators 27. A wide rectangular printed sheet 28 having side edges 28' is located on the surface 25 by contacting the opposed surfaces or locators 27 and by being received in opposed channels 26' in the locators 26. The upper surface of the printed sheet 28 is shown in FIG. 1 to be plain. The sheet 28 is shown to be face down and FIG. 4 shows the sheet 28 to have columns C1 through CN and rows R1 through R12 of visually readable characters 30. The printing cavity portions 21 in columns CM1 through CMN and rows RM1 through RM12 register with the columns C1 through CN and rows R1 through R12 of the sheet 28. The printed characters 30 are accurately registered or located with side edges 28' of the sheet 28. In a finished printing band PB as shown in FIGS. 6 through 8, when a printing character 22 is at the printing position the corresponding visually readable character 30 is at a predetermined location to the printing character 22; for example, prior art U.S. Pat. No. 3,968,745 shows that the visually readable character corresponding to the printing character at the printing zone is visible by peering through a window. While in the illustrated embodiment the printing and readable characters are opposite each other because the window is opposite the printing character, the amount of offset can vary in accordance with the location of the window. In any event there is correspondence between each printing character and the readable character which identifies it.

As shown in FIGS. 1 and 3, the mold blade 13 has parallel ribs 31 which result in the formation of lugs 32 and intervening hinges 33 on the underside of the wide endless band WB and the endless printing band PB. The lugs 32 enable the printing band PB to be advanced in a print head and can enable the printing band PB to be selectively detented into a selected operating position. The hinges 33 promote overall flexibility of the printing band PB. The wide band WB is slit along lines S to provide the printing bands PB.

As shown in FIG. 1, the mold blade 13 is wrapped with cords or threads 13'. The cords 13' extend across and in contact with outer surfaces of the ribs 31. The cords 13' help to prevent the printing band PB from stretching in a print head such as disclosed in U.S. Pat. No. 3,968,745. Upon injection of the moldable material into the mold 10, the moldable material is molded onto the cords 13' to provide a unitary wide endless band WB. The cords 13' do not interfere with slitting of the wide band WB into printing bands PB.

When the moldable material enters the mold 10 under pressure through a port 34, it fills the cavity between the mold parts 11 and 12 and around the mold blade 13 which has been wrapped with cords 13'. Excess moldable material and air exit through a small vent port 34'. The moldable material is adhered to the upper side of the printed sheet 28. The moldable material is bonded to the printed sheet 29. The printed sheet 28 is preferably a polyolefin and most preferably a polyethylene which is combined with silica. Other sheet materials can be used so long as the printed sheet 28 has the required flexibility, printability and durability to be suitable for a printing band for use in a print head. A printing band which is required to be repeatedly indexed in a print head must be able to withstand such use without breaking or delaminating. The moldable material bonds or is infused into the printed sheet 28 to provide permanent adherence to the moldable material of which the remainder of the printing band is composed. The moldable material which comprises the printing band PB can be any suitable elastomeric material such as urethane, nitrile rubber, and Buna N, but other materials can be used. In particular, one embodiment of the printable sheet suitable for in-mold applications comprises a continuous homogeneous material containing polyolefins (polyethylene) and insert fillers (silica) formed into a sheet and sold under the name Grafilm by Pinnacle Products Group, Ltd. Dayton, Ohio U.S.A. under part Nos. PHT010W and PHT007W. It may contain small amounts of calcium carbonate, titanium dioxide and trace hydrocarbon or mineral oils. The most preferred thickness of the sheet is 0.007 inch. The printed sheet 28 can be coated, e. g. silicone coated, following printing so that the visually readable portion 35 of the band can be readily cleaned. The wide band WB has trim portions 36 and 37 which are trimmed off following molding. The portion 37 has indicia 38 represented by the word "CODE" which help to identify the wide band WB during the manufacturing process. Each wide band with a different set up bears a different code.

The visually readable characters 30 on the sheet 28 can be printed by any suitable process, by way of example not limitation, lithography, silk screen printing, offset printing, thermal transfer printing, or photocopying.

While the printed sheet 28 can be suitably adhered to the wide band WB following molding as with an adhesive, this is not the preferred arrangement.

Other embodiments and modifications of the invention will suggest themselves to those skilled in the art, and all such of these as come within the spirit of this invention are included within its scope as best defined by the appended claims.

What is claimed is:

1. A wide endless composite band for use in making printing bands, comprising: a wide molded endless band composed of elastomeric material and having columns and rows of outwardly facing raised printing characters, and a sheet having columns and rows of outwardly facing printed visually readable characters adhered to the wide endless band, and the visually readable characters corresponding to like printing characters.

2. A wide endless composite band as defined in claim 1, wherein the sheet is comprised of polyethylene.

3. A wide endless composite band as defined in claim 1, wherein the printed sheet is comprised of a polyolefin and the wide endless band is comprised of a urethane.

4. A wide endless composite band as defined in claim 1, wherein the wide endless band is comprised of a urethane.

5. A wide endless composite band for use in making printing bands, comprising: a wide molded endless band composed of elastomeric material and having columns and rows of outwardly facing raised printing characters, and a sheet having columns and rows of outwardly facing printed visually readable characters molded onto the wide endless band, and the visually readable characters corresponding to like printing characters.

6. A wide endless composite band as defined in claim 5, wherein the sheet is comprised of polyethylene.

7. A wide endless composite band as defined in claim 5, wherein the printed sheet is comprised of a polyolefin and the wide endless band is comprised of a urethane.

8. A wide endless composite band as defined in claim 5, wherein the wide endless band is comprised of a urethane.

9. A composite printing band, comprising: an endless flexible band comprised of elastomeric material and having a column of outwardly facing raised printing characters, a strip adhered to the band and having a column of outwardly facing printed visually readable characters, and the visually readable characters corresponding to like printing characters.

10. A composite printing band, comprising: an endless flexible band comprised of elastomeric material and having a column of outwardly facing raised printing characters, a strip molded onto the band and having a column of outwardly facing printed visually readable characters, and the visually readable characters corresponding to like printing characters.

* * * * *